US006715479B1

(12) United States Patent
Bunk

(10) Patent No.: US 6,715,479 B1
(45) Date of Patent: Apr. 6, 2004

(54) TORQUELESS BUSS CABLE POSITIONER FOR A COMPOUND BOW

(75) Inventor: Paul H. Bunk, 1738 Welling, Troy, MI (US) 48098

(73) Assignees: Paul H. Bunk, Troy, MI (US); Peter D. Keefe, Roseville, MI (US)

( * ) Notice: Subject to any disclaimer, the term of this patent is extended or adjusted under 35 U.S.C. 154(b) by 0 days.

(21) Appl. No.: 10/371,287

(22) Filed: Feb. 21, 2003

(51) Int. Cl.[7] ..... F41B 5/10
(52) U.S. Cl. ..... 124/25.6
(58) Field of Search ..... 124/25.6

(56) References Cited

U.S. PATENT DOCUMENTS

| | | | | |
|---|---|---|---|---|
| 2,714,377 | A | | 8/1955 | Mulkey |
| 3,851,638 | A | | 12/1974 | Alexander |
| 3,989,026 | A | | 11/1976 | Nishioka |
| 4,203,412 | A | * | 5/1980 | Rickard |
| 4,207,858 | A | * | 6/1980 | Blackstone |
| 4,461,267 | A | | 7/1984 | Simonds et al. |
| 4,519,374 | A | | 5/1985 | Miller |
| 4,562,824 | A | | 1/1986 | Jennings |
| 4,570,606 | A | | 2/1986 | Peck |
| 4,662,344 | A | | 5/1987 | Mitchell |
| 4,705,015 | A | | 11/1987 | Troncoso, Jr. |
| 4,718,397 | A | | 1/1988 | Remick |
| 4,817,580 | A | | 4/1989 | Butterfield |
| 4,834,061 | A | | 5/1989 | Chattin |
| 4,903,677 | A | | 2/1990 | Colley et al. |
| 4,917,070 | A | | 4/1990 | Townsend |
| 4,919,108 | A | | 4/1990 | Larson |
| 4,971,020 | A | | 11/1990 | Soderstrom et al. |
| 5,054,463 | A | | 10/1991 | Colley et al. |
| 5,353,777 | A | | 10/1994 | Fincher |
| 5,503,135 | A | | 4/1996 | Bunk |
| 5,718,213 | A | * | 2/1998 | Gallops et al. |
| 5,722,385 | A | | 3/1998 | Bunk |
| 6,152,124 | A | * | 11/2000 | Gallops |

OTHER PUBLICATIONS

Bow Hunting Equipment Buyers Guide v. 45 No. 4 of Ehlert Publishing Group, Inc., Minnetonka, MN 55305; 1996.

"Mathews Solocam" Compound Bow Brochure of Mathews Archery, Sparta, WI 54656; Date Not Specified, Believed. Dated Early 1996.

* cited by examiner

*Primary Examiner*—John A. Ricci
(74) *Attorney, Agent, or Firm*—Peter D. Keefe

(57) ABSTRACT

A torqueless buss cable positioner for a compound bow which is fixedly mounted thereto, whereby the buss cables are displaced from the bow plane, yet, optimally, the buss cables do not subject the limbs to any force component perpendicular to the bow plane. A guided path for the buss cables is provided which includes first and second outboard guidance component for guiding the buss cables generally in the bow plane and an inboard guidance components for guiding the buss cables laterally off from the bow plane. The first and second outboard guidance components optimally ensure that the limbs are not subjected by the buss cables to any component of force perpendicular to the bow plane, and the inboard guidance component ensures that the buss cables are laterally displaced in relation to the bow plane sufficiently to be out of the way of the arrow and the sights of the compound bow. An inherent flexibility obviates pivoting in order to compliantly align with movement of the cam/wheel as the bow string is drawn/released.

6 Claims, 5 Drawing Sheets

TORQUELESS BUSS CABLE POSITIONER FOR A COMPOUND BOW

BACKGROUND OF THE INVENTION

1. Field of the Invention

The present invention relates to compound bows used in archery, including dual and single cam compound bows. More particularly the present invention relates to a buss cable positioner for laterally locating the buss cables out of the way of the area of space used for the arrow and for sighting. Still more particularly, the present invention relates to a buss cable positioner which eliminates limb torquing.

2. Description of the Related Art

Simple archery bows are composed of a bow member (or back) characterized by a handle having connected thereto on each side thereof a flexibly resilient limb, and a bow string connected with opposite ends of the bow member. The archer places the nock of an arrow against the nocking point of the bow string and then draws the bow string, thereby causing the bow member to resiliently flex at the limbs. This flexing of the bow member supplies tension to the bow string and stores potential energy (draw energy). When the bow string is released, the tension of the bow string applies a force to the arrow, whereupon the potential energy of the bow member is captured by the arrow in the form of kinetic energy. While such an archery bow has the advantage of being simply constructed, it suffers from the need of the archer to continuously supply draw pull to keep the bow member resiliently flexed. Another serious disadvantage is the essentially instantaneous application of bow string force upon the arrow at the moment the bow string is released, with consequent degredation of accuracy due to the imparted shock. An improved example of a simple archery bow using springs to reduce bow string shock is described in U.S. Pat. No. 4,570,606 to Peck.

These problems have been addressed in the past with varying degrees of success, wherein it is an object to provide an archery bow having a draw pull let-off feature, while yet providing a high level of draw energy for imparting ample speed to the arrow when released. In this regard, compound archery bows have been devised toward addressing this object, generally utilizing a rigging of the bow string with respect to one or more cams or pulleys which are rotatively mounted with respect to the bow member via buss cables. As the bow string is pulled back, the limbs of the bow member are caused to resiliently flex, while rotation of the cams or pulleys as the bow string is pulled back causes the force on the bow string to be high during pull back of the bow string and then let-off as the maximum draw point is achieved. Examples of such compound bows are described in U.S. Pat. No. 4,718,397 to Remick, U.S. Pat. No. 4,461,267 to Simonds et al, U.S. Pat. No. 4,562,824 to Jennings, and U.S. Pat. No. 4,519,374 to Miller. Imaginative and interesting variations on this principle are found in U.S. Pat. No. 5,045,463 to Colley et al, U.S. Pat. No. 4,817,580 to Butterfield, U.S. Pat. No. 3,851,638 to Alexander, and U.S. Pat. No. 2,714,377 to Mulkey.

As the bow string is drawn, the limbs of the bow resiliently bend in a bow plane which bisects the bow member. The arrow, bow sights, and bow string are all located in, or closely centered in, this plane; and, problematically, so, too, are the buss cables. While the nock of the arrow engages the nocking point of the bow string so that there is no conflict in position therebetween, this is not the case for the buss cables. Since the buss cables fall in the bow plane between the bow string and the bow member, they conflict positionally with the arrow and the bow sights. Accordingly, it is necessary to move the buss cables laterally with respect to the bow plane so that they are out of the way of the arrow and the bow sights.

FIGS. 1 and 1B depict a conventional compound bow 10. The bow string 12 is strung between the limbs 16*a,* 16*b* of the bow member 14. The bow string 12 lies substantially on the bow plane P (see FIG. 1B), wherein the bow plane is aligned with the bow string and bisection of the bow member 14. Buss cables 18*a,* 18*b* are positioned between the bow member 14 and the bow string 12 in a narrow zone centered on the bow plane P. The buss cables 18*a,* 18*b* are laterally repositioned a distance D (see FIG. 1B) with respect to the bow plane P via a slide-type positioner 20 in order to get the buss cables out of the way of the arrow and the sights of the compound bow at the arrow nocking point a lateral distance D'. The rod 22 of the slide-type buss cable positioner 20 is connected with the bow member 14 and is located at a position laterally displaced with respect to the bow plane P (wherein in FIG. 1B the bow plane is at the bow string). The slide 24 of the slide-type positioner 20 has a concave rod seat which slidingly interfaces with the rod 22. Opposite the rod seat, the slide 24 has two concave cable guides for receiving, respectively, each of the buss cables 18*a,* 18*b* at the desired distance D from the bow plane.

In operation, as the bow string is drawn back, the buss cables interact with the cam 26 (or cams in two cam compound bows) to cause the limbs to be resiliently bent toward each other in the bow plane. The buss cables are prevented from encroaching too near the bow plane by action of the slide-type positioner 20, so that an arrow and the sights of the compound bow are not interfered therewith.

Problematically, however, the buss cables have been forced laterally with respect to the bow plane by the slide-type positioner 20. This lateral displacement results in a force F perpendicular to the bow plane P (see FIG. 1B). This perpendicular force F is transmitted in one direction to the handle of the bow member 14 and in the opposite direction to the limbs 16*a,* 16*b,* resulting in a limb torque off the bow plane P. This limb torque results in inaccuracy in arrow aiming, since the bow string is not precisely being tensioned in the bow plane by the limbs. Further, the slide-type positioner 20 suffers from associated vibration, noise and frictionally introduced hesitation effects as the slide moves along the rod (see arrow S) in concert with buss cable travel associated with the peripheral contact of the buss cables with the cam(s).

Accordingly, what yet remained needed in the art was a positioner for buss cables which effects lateral repositioning of the buss cables, but, optimally, did not introduce any limb torque.

A major breakthrough in compound bow technology was forwarded by Paul H. Bunk in his U.S. Pat. 5,722,385, the entire disclosure of which is hereby herein incorporated by reference. Bunk addressed the issue of buss cable positioner limb torque by providing a guide member which serves to move the buss cables out of the way or the arrow, yet ensures the limbs see no torque.

According to Bunk, and as shown at FIG. 2, a torqueless buss cable positioner 100 is characterized by a guide member 122 pivotally mounted to a compound bow 102. The compound bow has a bow member 106, a handle section 108 and limbs 110*a,* 110*b.* Cams 112*a,* 112*b* are rotatably connected, respectively, to the end of each of the limbs. The compound bow further includes a bow string 104 which is drawn back into the bow plane of the compound bow and a pair of buss cables 116*a,* 116*b.* The guide member 122 includes a frame 126, a first pulley set 128 connected to one end of the frame, a second pulley set 130 connected to the other end of the frame, and a third pulley set 132 connected preferably medially to the frame. The frame is shaped, such as for example by a curve, whereby the first and second pulley sets mutually define an alignment axis, but the third pulley set is laterally displaced relative to the alignment axis. The frame is optimally structured and mountably positioned relative to the bow member so that the grooved periphery of each of the first and second pulley sets is located generally at the bow plane and the grooved periphery of the third pulley set is laterally displaced off from the bow plane a distance determined by the required buss cable displacement for the particular compound bow to which the torqueless tension cable positioner is utilized. As the bow string is drawn back in the bow plane, the entry location of the buss cables at the groove periphery of the cams of the compound bow change in distance from the axis of rotation of the cams at the limbs due to cam rotation and limb bending. To accommodate this movement of the buss cables, the guide member 122 pivots via the frame 126 being pivotally mounted to the bow member so that the pulley sets can follow the resulting travel of the buss cables. The pivotability of the guide member relative to the bow member is provided by pivotal connection of the frame to a mounting bracket 124 which is, in turn, mounted to the bow member, preferably with a spring biasing. It is also preferred for the mounting bracket, itself, to be pivotally mounted to the bow member, also, preferably, with its own spring biasing.

While the merits of the Bunk concept are legion, there yet remains a need to simplify the mechanics, particularly a need to eliminate parts and pivoting of the parts.

SUMMARY OF THE INVENTION

The present invention is a torqueless buss cable positioner for a compound bow which is fixedly mounted thereto, whereby the buss cables are displaced from the bow plane, yet, optimally, the buss cables do not subject the limbs to any force component perpendicular to the bow plane.

The torqueless buss cable positioner according to the present invention provides a guided path for the buss cables which includes first and second outboard guidance components for guiding the buss cables generally in the bow plane and an inboard guidance component for guiding the buss cables laterally off from the bow plane. The first and second outboard guidance components optimally ensure that the limbs are not subjected by the buss cables to any component of force perpendicular to the bow plane, and the inboard guidance component ensures that the buss cables are laterally displaced in relation to the bow plane sufficiently to be out of the way of the arrow and the sights of the compound bow. Further, the torqueless buss cable positioner according to the present invention has an inherent flexibility which obviates pivoting in order to compliantly align with movement of the cams/wheels as the bow string is drawn/released.

The torqueless buss cable positioner according to the present invention is characterized by a guide member fixedly mounted to the bow member, wherein by the term "fixedly mounted" is meant that the guide member is non-pivotally mounted relative to the bow member. The guide member includes a flexible (preferably resiliently flexible) guide bar, a first outboard guidance component connected to one end of the guide bar, a second outboard guidance component connected to the other end of the guide bar, and an inboard guidance component connected preferably medially to the guide bar. The guide bar is shaped, such as for example by a curve, whereby the first and second outboard guidance components mutually define an alignment axis, but the inboard guidance component is laterally displaced relative to the alignment axis (that is, displaced perpendicular to the bow plane).

In the preferred embodiment, the first outboard guidance component is composed of a first pulley set rotatably connected to one end of the guide bar, the second outboard guidance component is a second set of pulleys rotatably connected to the other end of the guide bar, and the inboard guidance component is a third pulley set rotatably connected to a medial portion of the guide bar. The guide bar is fixedly connected to the bow member by a rigid connection member, preferably in the form of a rigid mounting rod fixedly connected to both the guide bar and the bow member.

The guide bar is optimally structured and mountably positioned relative to the bow member so that the grooved periphery of each of the first and second pulley sets is located generally at the bow plane and the grooved periphery of the third pulley set is laterally displaced off from the bow plane a distance determined by the required buss cable displacement for the particular compound bow to which the torqueless tension cable positioner is utilized. As the bow string is drawn back into the bow plane, the entry location of the buss cables at the groove periphery of the cam/wheel of the compound bow change in distance from the axis of rotation of the cam(s) at the limb(s) due to cam rotation and limb bending. To accommodate this buss cables movement, the guide bar is flexible in the bow plane, but is generally rigid along the other two planes perpendicular thereto. Accordingly, the guide bar flexes so that the first and second pulley sets can follow the resulting travel of the buss cables as the bow string is drawn or released.

Accordingly, it is an object of the present invention to provide a torqueless buss cable positioner for compound bows, whereby the buss cables are laterally displaced with respect to the bow plane, yet, optimally, the limbs of the bow are not subjected to a perpendicular component of force by the buss cables.

It is an additional object of the present invention to provide a torqueless buss cable positioner for compound bows, wherein a guide member is fixedly mounted to the bow member, but includes a flexible guide bar which flexes (or bends) in compliant alignment with movement of the buss cables as the bow string is drawn or released.

These, and additional objects, advantages, features and benefits of the present invention will become apparent from the following specification.

DETAILED DESCRIPTION OF THE PREFERRED EMBODIMENT

Figure 1:
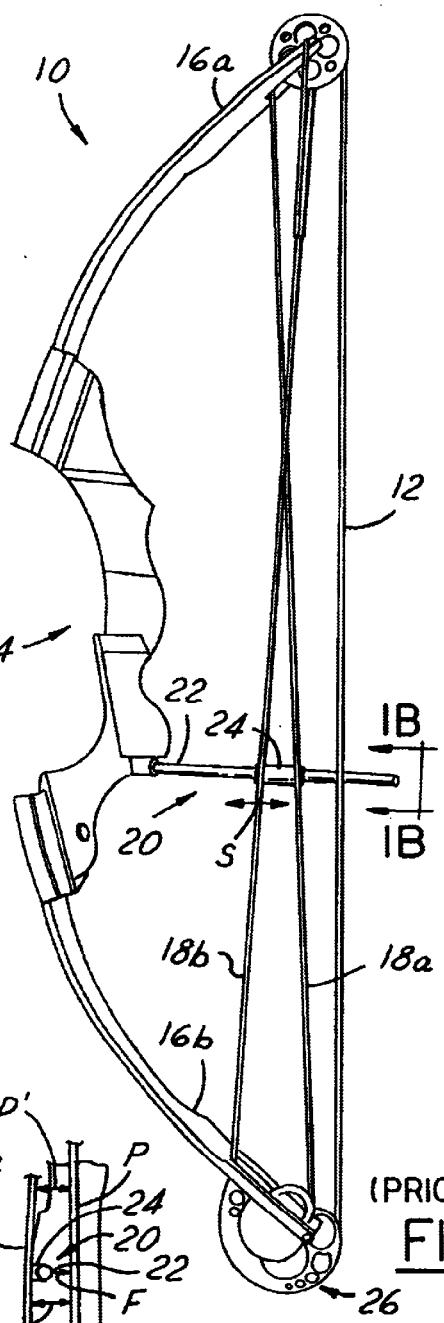
(PRIOR ART) FIG.1
FIGS. 1 and 1B are depictions of a prior art compound bow having a conventional slide-type buss cable positioner.
Figure 1B:
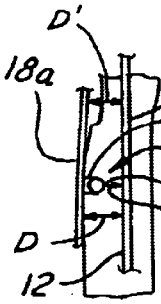
(PRIOR ART) FIG.1B
Figure 2:
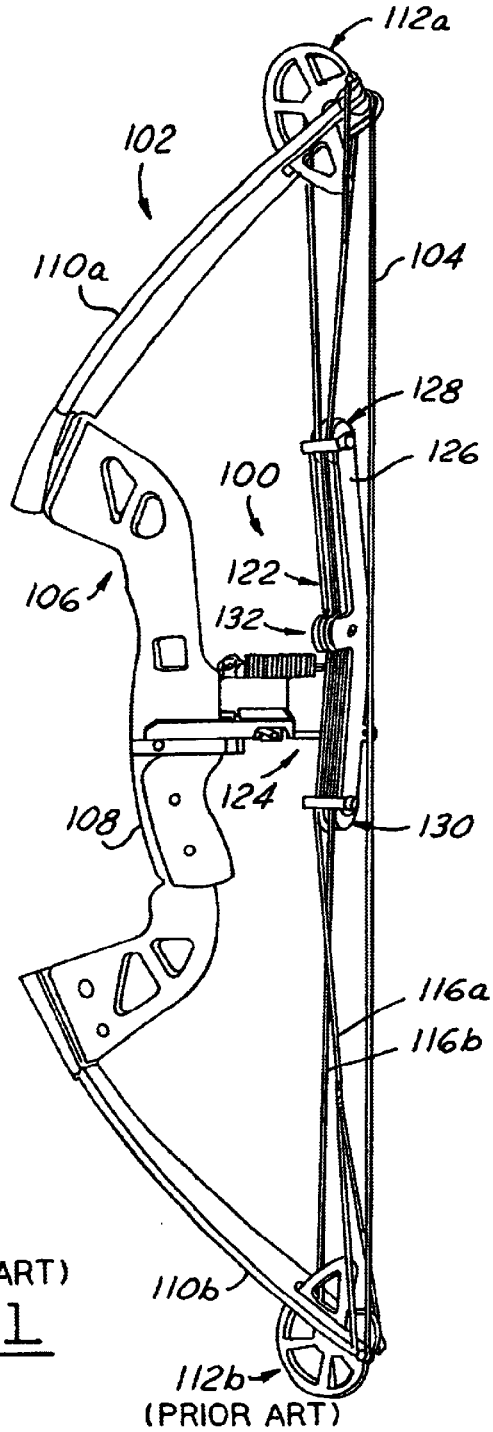
(PRIOR ART) FIG.2
FIG. 2 is somewhat perspective, mainly side view of a compound bow equipped with a pivotally mounted torqueless buss cable positioner according to U.S. Pat. No. 5,722,385, shown where the bow string is at its rest position.

Referring now to FIGS. 3 through 6 the torqueless buss cable positioner 200 according to the present invention will be described with reference to a single cam compound bow. It is to be understood that a single cam compound bow is shown merely by way of exemplification, and that the torqueless buss cable positioner is equally applicable to a double cam compound bow (of the type shown in FIG. 2).

Figure 3:
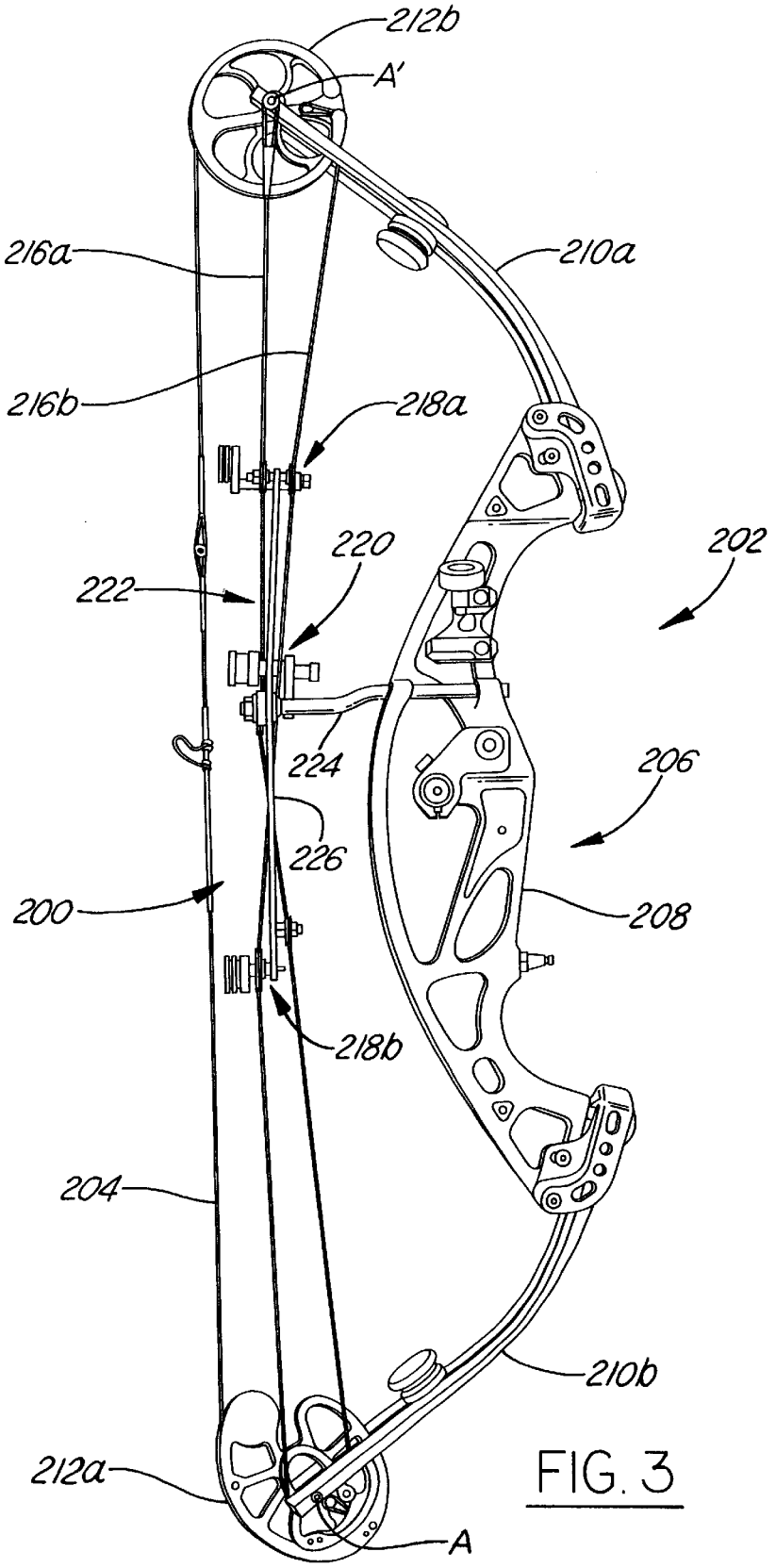
FIG. 3 is somewhat perspective, mainly side view of a compound bow equipped with a fixedly mounted torqueless buss cable positioner according to the present invention, shown where the bow string is at its rest position.
Figure 4:
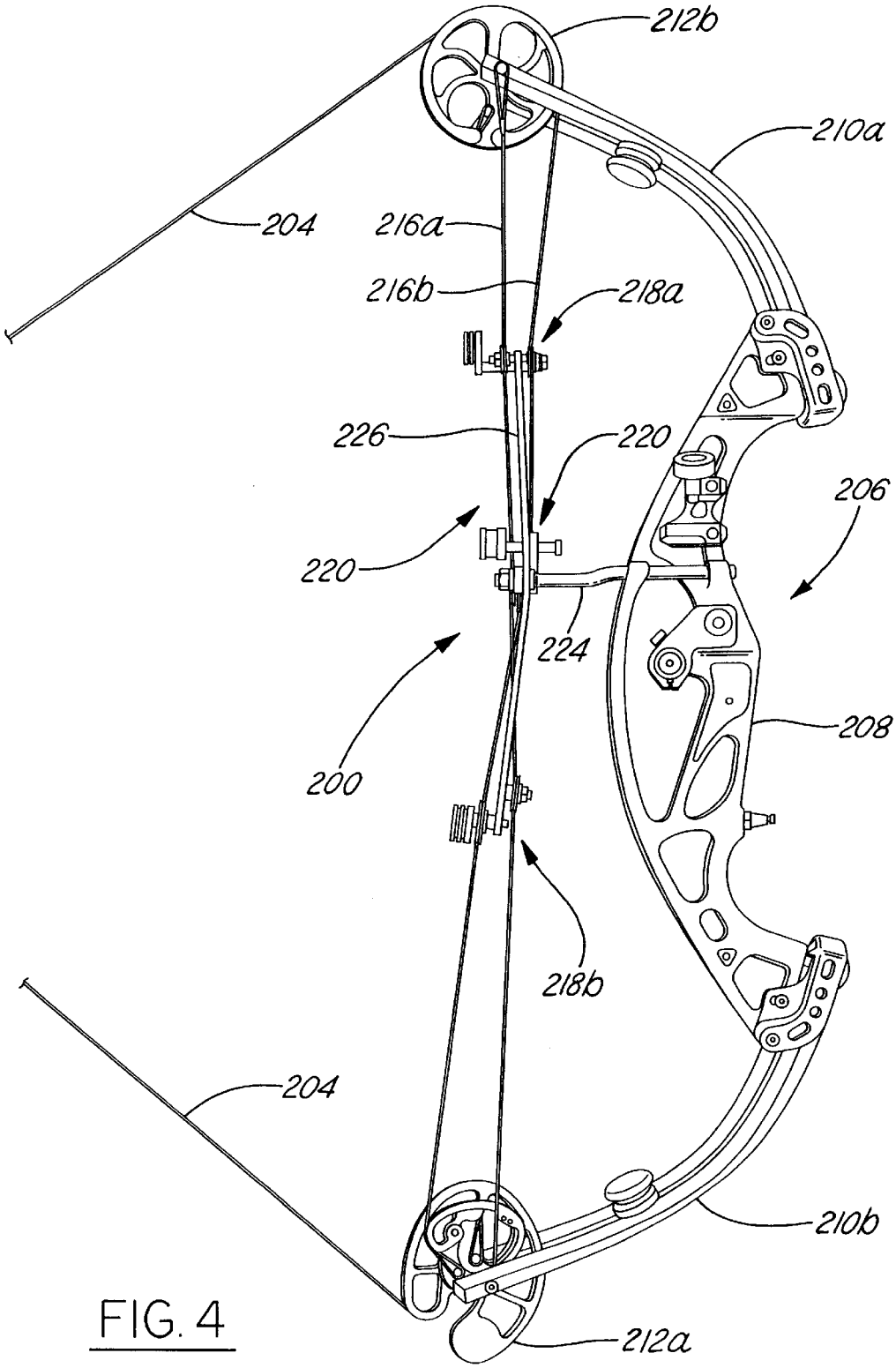
FIG. 4 is a somewhat perspective, mainly side view of a compound bow equipped with the fixedly mounted torqueless buss cable positioner according to the present invention, shown where the bow string is at its drawn position.
Figure 6:
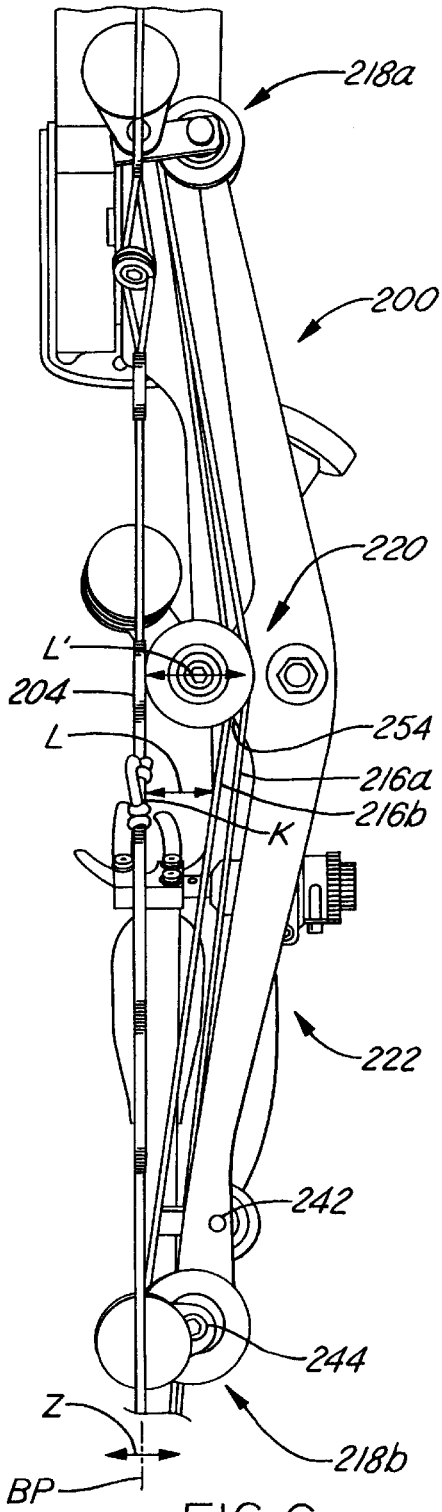
FIG. 6 is a partly broken away, somewhat perspective, mainly end view of the compound bow, as in FIG. 5, where the fixedly mounted torqueless buss cable positioner according to the present invention is again particularly shown.

FIGS. 3 and 4 depict a compound bow 202 equipped with the torqueless buss cable positioner 100, wherein FIG. 3 depicts the configuration where the bow string 204 is at its rest position, and FIG. 4 depicts the configuration where the bow string is at its drawn position. It will be discerned that the compound bow 202 includes, conventionally, a bow member 206 having a handle section 208 and limbs 210*a,* 210*b* at either end of the handle section. A cam 212*a,* and a wheel 212*b* are rotatably connected, respectively, to each end of the limbs 210*a,* 210*b,* wherein the cam and the wheel rotate on respective rotation axes A, A' (see FIG. 4). A bow plane BP of the bow member 206 is defined by a bisection of the bow member such that the curvature of the limbs 210*a,* 210*b* is in the bow plane (see FIG. 6), wherein the bow string 204 is located at the bow plane. Each end of the bow string 204 is wound, respectively, on a peripheral string groove and is then terminated on the respective cam/wheel 212*a,* 212*b.* The compound bow 202 further includes a pair of buss cables 216*a,* 216*b,* wherein for example, one buss cable is strung between a fixed connection with the end of a limb and a termination at a peripheral first cable groove of the cam, and the other buss cable is strung between a termination at a peripheral cable groove of the wheel and a termination at a peripheral second cable groove of the cam. The buss cables 216*a,* 216*b,* as shown at FIG. 6, are located in a narrow zone Z centered on the bow plane BP. The exact arrangement of the rigging of the bow string and the buss cables may vary with particular compound bows (be that single or double cam), and the present description is merely for instructive exemplification based upon conventional rigging.

In operation of the compound bow 202, when the bow string 204 is drawn from its rest position as shown in FIG. 3 to its drawn position as shown in FIG. 4, the cam 212*a* and wheel 212*b* rotate on their respective rotation axes A, A' as the bow string unwinds off the string grooves. Rotation of the cam 212*a,* and wheel 212*b* results in the buss cables 216*a,* 216*b* being wound onto their respective cable grooves. As a result, the limbs 210*a,* 210*b* are caused to be resiliently pulled toward each other in the bow plane BP thereby creating potential energy for propelling an arrow.

It will be noted that the string grooves place the bow string 204 more-or-less at the bow plane BP, while the fixed connection and the cable grooves place the buss cables 216*a,* 216*b* somewhere within the zone Z in the vicinity of the arrow nocking location K (see FIG. 6). The small displacements of the buss cables and the bow string is optimally symmetrically distributed in relation to the bow plane BP, so that no (or very little) perpendicular component of force is delivered to the limbs when the bow string is drawn when the effects introduced by a buss cable positioner are ignored.

In order that the buss cables 216*a,* 216*b* not interfere with the arrow at the arrow nocking location K, it is necessary to reposition the buss cables laterally (perpendicularly) off the bow plane BP sufficiently so that they do not interfere with the arrow or sights of the bow member 202. As depicted in FIG. 6, the length of the displacement L is considerably larger than the maximum displacement of the buss cables in the zone Z in the vicinity of the arrow nocking location K. For example, Z could be about one-quarter inch and L could be about one inch from the bow plane BP at the arrow nocking point K. Accordingly, the torqueless buss cable positioner 200 is employed to provide the necessary length of displacement L, while optimally ensuring that no perpendicular forces are applied to the limbs on account of the repositioning of the buss cables, as would occur with a conventional slide-type buss cable positioner.

The structure and function of the torqueless buss cable positioner 200 according to the present invention will now be more particularly detailed. In this regard, the torqueless buss cable positioner 200 provides a guided path for the buss cables 216*a,* 216*b* whereby first and second outboard guidance components 218*a,* 218*b* provide guiding of the buss cables in the zone Z and an inboard guidance component 220 provides guiding of the buss cables laterally off the bow plane by a length of displacement of L (see FIG. 6). Optimally, the first and second outboard guidance components 218*a,* 218*b* are aligned with the limbs 210*a,* 210*b* and the bow plane BP so that the limbs are not subjected by the buss cables 216*a,* 216*b* to any component of force perpendicular to the bow plane.

The preferred embodiment of the torqueless buss cable positioner 200 is characterized by a guide member 222 fixedly (non-pivotally) mounted to the bow member 206 via a rigid connection member 224. The guide member 222 includes an elongated guide bar 226, first and second pulley sets 228,230 (serving as the first and second outboard guidance components 218*a,* 218*b*), and a third pulley set 232 (serving as the inboard guidance component 220), the pulleys being rotatably connected with the guide bar for rollingly guiding the buss cables 216*a,* 216*b.* Preferably, the rotatable connection of the pulleys to the guide bar 226 is provided by ball bearings. The first pulley set 228 is connected to one end of the guide bar 226; the second pulley set 230 is connected to the other end of the guide bar; and the third pulley set 232 is connected to the guide bar between the first and second pulley sets, preferably medially therebetween.

The guide bar 226 is composed of any durable material which exhibits flexibility if thin, and rigidity if thick. The guide bar 226 is oriented relative to the bow member 206 so as to be thin in the bow plane, and in the other two perpendicular planes the guide bar is, in width, relatively thick, and, in length, relatively elongated. For example, the guide bar may be composed of aluminum having a thickness in the bow plane of about 0.2 inches, and may be widest at the center, for example having a width of about 1.0 inch, and the taper towards the ends, which a minimum width of between about 0.3 inches and about 0.4 inches. Other materials may be used besides aluminum for the guide bar 226, such as for example other metals, plastics, fiberglass and composites. The guide bar 226 is preferably in the form of an arcing curvilinear shape, whereby the first and second pulley sets 228, 230 mutually define an imaginary alignment axis therebetween (this generally coincides with the bow lane), but the third pulley set 232 is laterally displaced relative to the alignment axis the length of displacement L (shown best at FIG. 6). The guide bar 226 is mountably positioned relative to the bow member 206 so that the grooved periphery of each of the first and second pulley sets 228, 230 is located in the zone Z narrowly centered on the bow plane BP, while the grooved periphery of the third pulley set 232 is laterally displaced off the bow plane the displacement distance determined by the required buss cable displacement for the particular compound bow to which the torqueless tension cable positioner is utilized. In the preferred embodiment shown in the Drawing, the third pulley set 232 is not located adjacent the arrow nocking point K (see FIG. 6); consequently, the buss cables are displaced a distance L'>L by providing a displacement distance of the third pulley set a distance L' as measured from the bow plane BP.

The preferred connecting member 248 is a rigid mounting rod fixedly (non-pivotally) connected to the guide bar 226 at a mounting hole therein via a threaded nut 234*a* and an abutment 234*b* connected with the mounting rod. The mounting rod 224 is fixedly (non-pivotally) attached to the bow member 206, for example by a press-fit retention at the attachment receptacle 256 used for a conventional buss cable positioner (making mounting of the torqueless buss cable positioner 200 an easy retrofit for conventional compound bows).

With regard to each of the first, second and third pulley sets 228, 230, 232, two pulleys are provided, one, respectively, for each buss cable 216*a*, 216*b*. Where only one or more than two buss cables are present, then the number of pulleys is similarly present for respectively receiving each buss cable.

Figure 5:
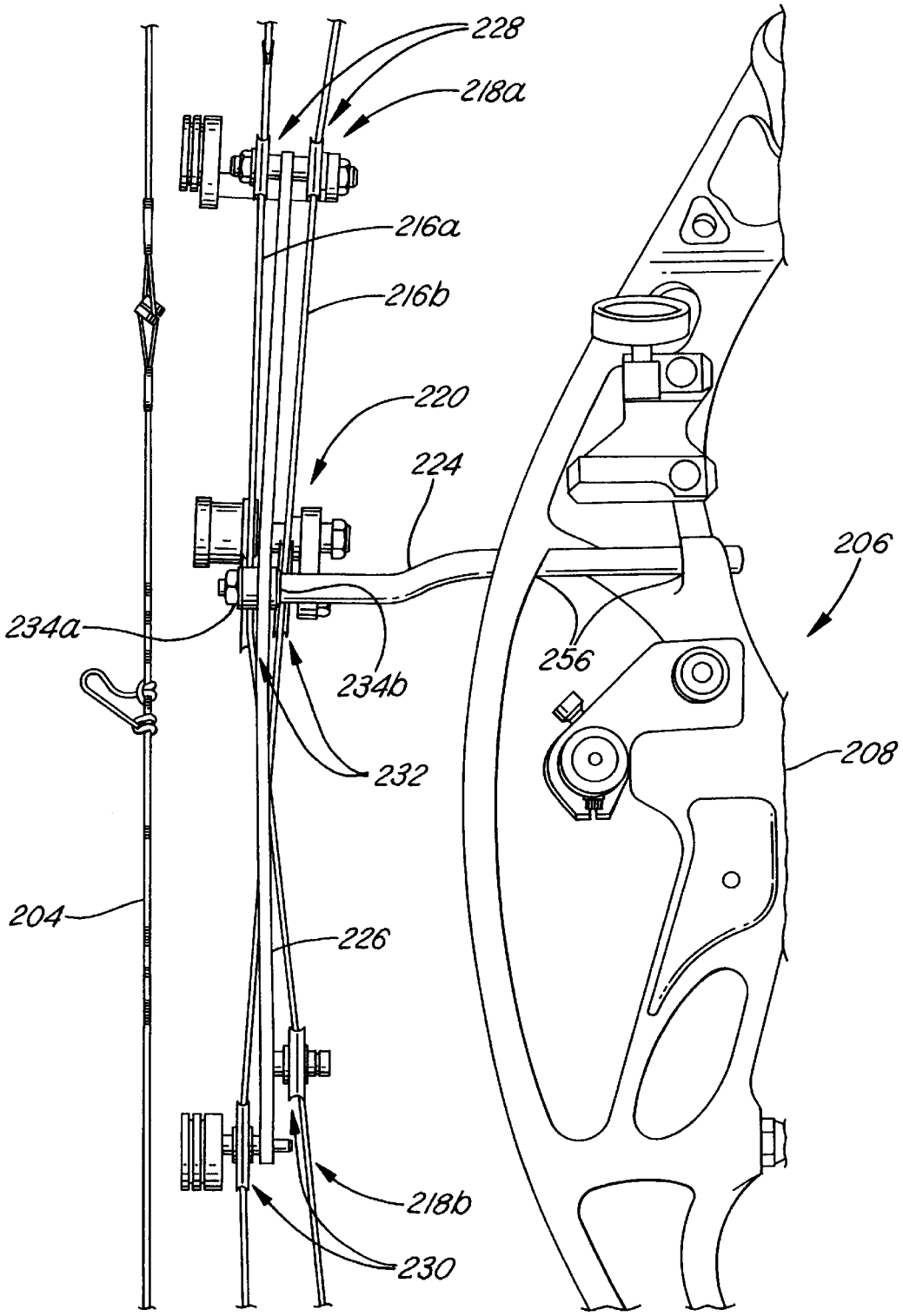
FIG. 5 is a partly broken away, somewhat perspective, mainly side view of a compound bow, where the fixedly mounted torqueless buss cable positioner according to the present invention is particularly shown.
Figure 5A:
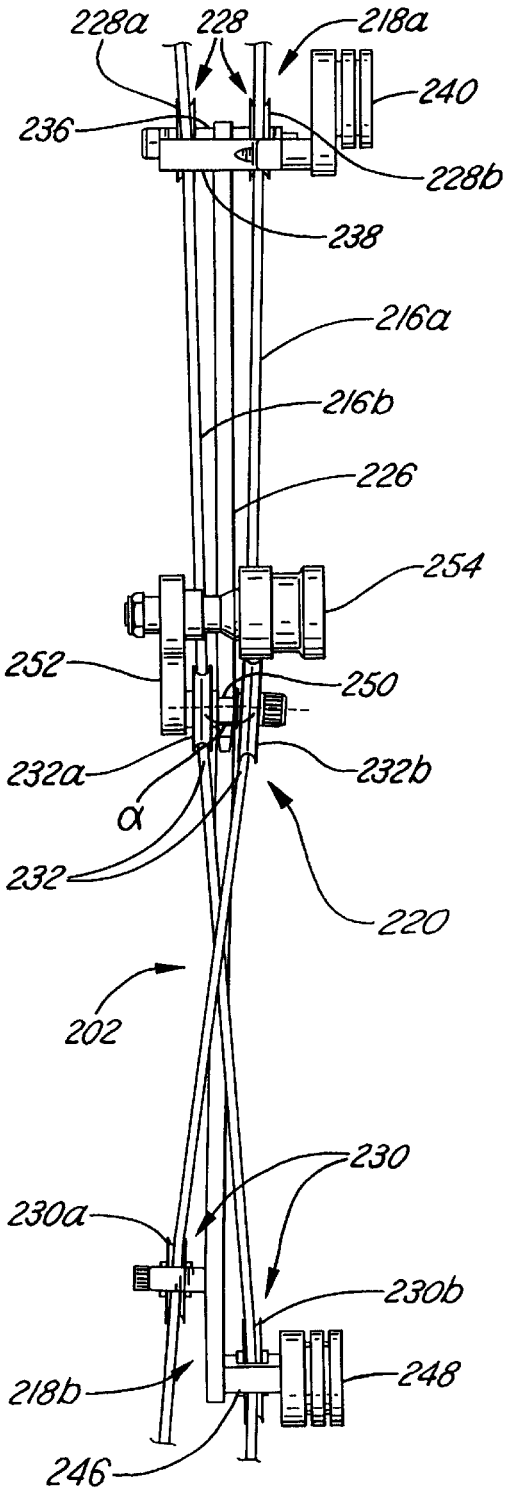
FIG. 5A is a partly broken away, somewhat perspective, mainly side view of a compound bow, where shown is a detail of the fixedly mounted torqueless buss cable positioner, viewed from an opposite side as that viewed at FIG. 5.

The pulleys are mounted, located and sized to accommodate the buss cable placement characteristic of a particular compound bow. For example, in the example depicted in the Drawings, it will be seen that the following features are present (see mainly FIG. 5A). The first pulley set 228 has the same diameter first and second pulleys 228*a*, 228*b* mutually aligned on either side of the mounting bar 226 on a common axle rod 236. A first U-bracket 238 provides added rigidity and a mounting for a first bow string shock absorber 240. The second pulley set 230 has differing diameter third and fourth pulleys 230*a*, 230*b* in mutually off-set alignment on either side of the mounting bar 226, wherein the third pulley 230*a* is mounted independently on its axle rod 242 (see FIG. 6), and the fourth pulley 230*b* is mounted independently on its axle rod 244 (see FIG. 6). A second U-bracket 246 at the fourth pulley 230*b* provides added rigidity and a mounting for a second bow string shock absorber 248. The third pulley set 232 has different diameter fifth and sixth pulleys 232*a*, 232*b* mounted on either side of the mounting bar 226 with a dihedral angle $\alpha$ being therebetween provided (ie., about 175 degrees) on a slightly bent common axle rod 250 which is mounted to a slightly reduced thickness knob 254 of the mounting bar (see FIG. 6). Connected to the axle rod 250 is an arm 252 supporting a third bow string shock absorber 254. The arrangement of larger and smaller pulleys of the second and third pulley sets 228,230 aids in reducing limb torque and ensures efficient buss cable guidance.

Operatively, in that as the bow string 204 is drawn the cam/wheel 212*a*, 212*b* rotate and the limbs 210*a*, 210*b* close together and the ends thereof move rearwardly moving relative to the handle 208, the mounting bar 226 flexes, preferably resiliently, so that the first and second pulley sets 228, 230 (which constitute the first and second outboard guidance components 218*a*, 218*b*) can compliantly follow the movement of the buss cables 216*a*, 216*b*. Thus, as mentioned above, the mounting bar 226 has a relatively thin thickness in the bow plane so that flexing in the bow plane allows the ends thereof to follow the movements of the buss cables. It should be noted that since the guide bar 224 is attached rigidly to the connection member 224, the flexing does not occur in the immediate vicinity (the medial portion) of the guide bar where the connection member attaches. The flexing of the mounting bar 226 is exemplified by comparison of FIGS. 3 and 4. In FIG. 3 the mounting bar 226 is slightly bent forwardly toward the handle 208 responsive to tension of the buss cables at the relaxed state of the bow string 204. In FIG. 4, the mounting member 226 has bent rearwardly away from the handle responsive to tension of the buss cables at the drawn state of the bow string.

It will be understood that the concept of the present invention is to provide mutually spaced apart outboard guidance locations of the buss cables such that the limbs are not subjected to a force component perpendicular to the bow plane. In the preferred embodiment, this feature is provided by the location of the first and second pulley sets. It is further the concept of the present invention to provide an inboard guidance location of the buss cables between the outboard guidance locations, whereby the buss cables are laterally displaced a length L from the bow plane BP which is needed to get the buss cables out of the way of the arrow at its nocking location K. In the preferred embodiment, this feature is provided by the location of the third pulley set. In order for the concept of the present invention to function with varying amounts of draw of the bow string, the first and second outboard guidance components are relocated by flexing of the guide bar so as to accommodate cam induced and limb bending induced travel of the buss cables.

As indicated hereinabove, while the torqueless buss cable positioner 200 has been described in relation to a single cam compound bow, the over all discussion thereof remains substantially the same with regard to a dual cam compound bow, the rigging being now particular thereto, wherein FIGS. 3 through 6 are analogously descriptive of the torqueless buss cable positioner 200 used therewith. Accordingly, further discussion of the torqueless buss cable positioner 200 is unwarranted for those of ordinary in the archery art to understand its implementation on a single cam compound bow.

Further, while a right-hand compound bow has been shown in the Drawing, it is to be understood the torqueless buss cable positioner 200 is equally usable with a left-hand compound bow, wherein its arrangement relative to the bow member is inverse to the bow plane.

To those skilled in the art to which this invention appertains, the above described preferred embodiment may be subject to change or mortification. Such change or mortification can be carried out without departing from the scope of the invention, which is intended to be limited only by the scope of the appended claims.

What is claimed is:

1. A buss cable positioner for a compound bow, the compound bow having a bow member and at least one buss cable, said buss cable positioner comprising:

a guide member, comprising:

a flexible guide bar;

a first outboard guidance component connected to said guide bar;

a second outboard guidance component connected to said guide bar in spaced relation to said first outboard guidance component, wherein an imaginary axis extends between said first and second outboard guidance components; and an inboard guidance component connected to said guide bar between said first and second outboard guidance components, said inboard guidance component being displaced with respect to said imaginary axis; and a rigid connection member fixedly connected to the guide bar, wherein the connection member is adapted to fixedly connect said guide bar to the bow member;

wherein said first and second outboard guidance components provide guidance of at least one buss cable at two mutually spaced outboard locations along said imaginary axis, and said inboard guidance component guides the at least one buss cable at an inboard location displaced in relation to said imaginary axis.

2. The buss cable positioner of claim 1, wherein said first and second outboard guidance components and said inboard guidance component comprise:

at least one first pulley rotatably connected to said guide bar substantially adjacent a first end thereof;

at least one second pulley rotatably connected to said guide bar substantially adjacent a second end thereof; and at least one third pulley rotatably connected to said guide bar between said at least one first and second pulleys;

wherein said connection member is connected to said guide bar substantially adjacent said at least one third pulley.

3. A compound bow comprising:

a bow member having an arrow nocking location, said bow member comprising:

a handle section having a first and an opposite second end;

a first limb connected with said first end of said handle section; and a second limb connected with said second end of said handle section;

at least one cam connected with at least one of said first and second limbs;

a bow string strung between said first and second limbs, said bow string being windably connected with said at least one cam; and at least one buss cable strung between said first and second limbs, said at least one buss cable being windably connected with said at least one cam;

wherein said bow member is bisected by a bow plane, and wherein said stringing of said bow string and said at least one buss cable places said bow string and said at least one buss cable in a zone centered on, and substantially proximate to, said bow plane at said arrow nocking location; and a buss cable positioner comprising:

a guide member, comprising:

a guide bar;

a first outboard guidance component connected to said guide bar;

a second outboard guidance component connected to said guide bar in spaced relation to said first outboard guidance component, wherein an imaginary axis extends between said first and second outboard guidance components; and an inboard guidance component connected to said guide bar between said first and second outboard guidance components, said inboard guidance component being displaced with respect to said imaginary axis; and a rigid connection member fixedly connected to the guide bar and fixedly connected to said bow member;

wherein said first and second outboard guidance components provide guidance of said at least one buss cable at two mutually spaced outboard locations along said imaginary axis, and said inboard guidance component guides said at least one buss cable at an inboard location displaced in relation to said imaginary axis in a direction perpendicular to said bow plane; and wherein said guide bar is flexible in said bow plane; and wherein said outboard locations are located within said zone, and wherein said inboard location is located outside said zone.

4. The compound bow of claim 3, wherein the flexibility of said guide bar is resilient.

5. The compound bow of claim 3, wherein said first and second outboard guidance components and said inboard guidance component comprise:

at least one first pulley rotatably connected to said guide bar substantially adjacent a first end thereof;

at least one second pulley rotatably connected to said guide bar substantially adjacent a second end thereof; and at least one third pulley rotatably connected to said guide bar between said at least one first and second pulleys;

wherein said connection member is connected to said guide bar substantially adjacent said at least one third pulley.

6. The compound bow of claim 3, wherein said at least one buss cable comprises two buss cables; and wherein said first and second outboard guidance components and said inboard guidance component comprise:

a first pulley set rotatably connected to said guide bar substantially adjacent a first end thereof;

a second pulley set rotatably connected to said guide bar substantially adjacent a second end thereof; and a third pulley set rotatably connected to said guide bar between said at least one first and second pulley sets;

wherein said connection member is connected to said guide bar substantially adjacent said at least one third pulley set.

* * * * *